US005207631A

United States Patent [19]

Schmidtke et al.

[11] Patent Number: 5,207,631

[45] Date of Patent: May 4, 1993

[54] METHOD AND APPARATUS FOR FOLDING OF SHEET MATERIAL

[75] Inventors: Thomas J. Schmidtke; Joachim G. Schmidtke, both of Ortonville, Mich.

[73] Assignee: Fabmation, Inc., Flint, Mich.

[21] Appl. No.: 721,866

[22] Filed: Jun. 26, 1991

[51] Int. Cl.[5] ..... B31B 1/25; B31D 5/00

[52] U.S. Cl. ..... 493/334; 108/51.3; 493/402; 493/379; 493/390; 493/423; 493/441; 493/399

[58] Field of Search ..... 493/334, 370, 391, 393, 493/399, 402, 403, 407, 438, 441, 446, 455, 464, 964, 965, 423; 108/51.3

[56] References Cited

U.S. PATENT DOCUMENTS

| | | | |
|---|---|---|---|
| 1,777,285 | 10/1930 | Adsit . | |
| 1,903,243 | 3/1933 | Peck | 493/423 |
| 2,494,730 | 1/1950 | Thursby | 108/51.3 |
| 2,976,779 | 3/1961 | Hamilton et al. . | |
| 3,398,661 | 8/1988 | Mathes et al. . | |
| 3,464,371 | 9/1969 | Gifford | 108/51.3 |
| 3,683,822 | 8/1972 | Roberts et al. . | |
| 3,913,464 | 10/1975 | Flaum . | |
| 4,462,653 | 7/1984 | Flederbach et al. . | |
| 4,512,755 | 4/1985 | Stone . | |
| 4,563,377 | 1/1986 | Melli . | |
| 4,792,325 | 12/1988 | Schmidtke . | |
| 4,863,024 | 9/1989 | Booth | 108/51.3 |
| 4,867,074 | 9/1989 | Quasnik | 108/51.3 |
| 4,979,446 | 12/1990 | Winebarger | 108/51.3 |

*Primary Examiner*—Bruce M. Kisliuk
*Assistant Examiner*—Jack Lavinder
*Attorney, Agent, or Firm*—Marshall & Melhorn

[57] ABSTRACT

There is disclosed a method and apparatus for folding of sheet material into symmetrical and nonsymmetrical shapes. The method and apparatus is shown as applied to making a pallet construction wherein a series of symmetrical stringer members made on the apparatus of the present invention are inserted into an equal plurality of nonsymmetrically shaped cross-stringers, also made by the apparatus of the present invention, both of which have had adhesive applied while being folded to retain the shape into which they are made, a top sheet is applied and also glued in place to make a pallet. The method involves essentially supplying a sheet of material such as a fiberboard blank of appropriate composition and size, running the blank through crushing and scoring rollers to produce fold lines in the blank, and asymmetrically (making more folds from one side of the blank than from the other side) or symmetrically folding the blank into a predetermined shape while applying adhesive at predetermined points. The blank is folded by passing it through a multi-function folding means, including a lifting means which can slightly lift the outside edge of the blank until a belt-like folding and propelling means can then fold one panel of a blank over onto the other panel while adhesive is being applied. The folding operation can be repeated as many times as is needed to form the part.

13 Claims, 14 Drawing Sheets

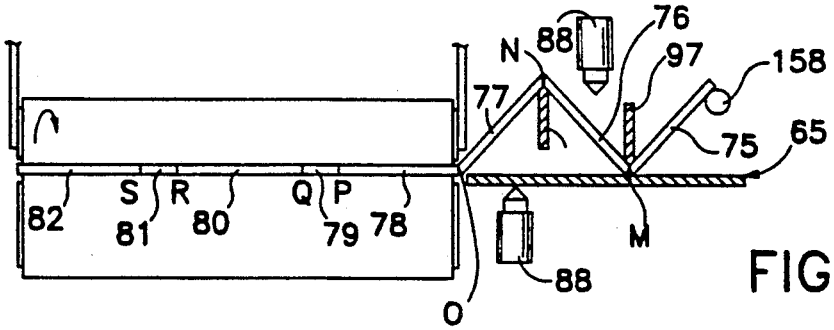
FIG. 24
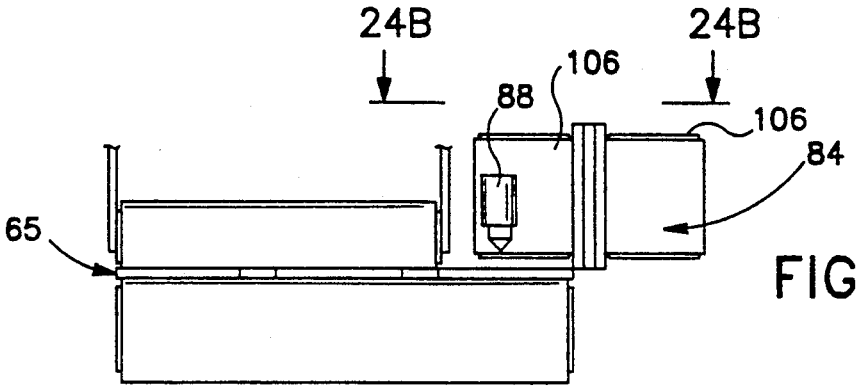
FIG. 24A
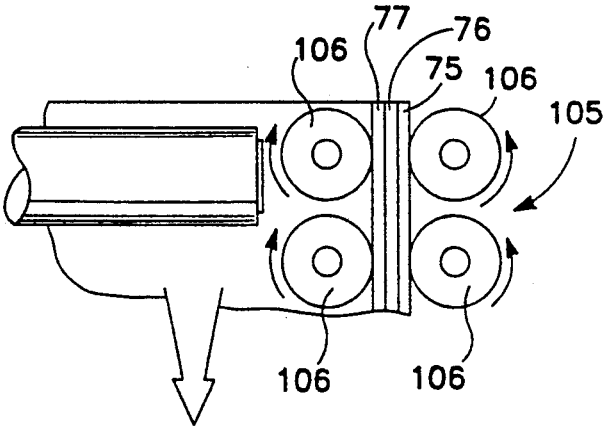
FIG. 24B
FIG. 23B
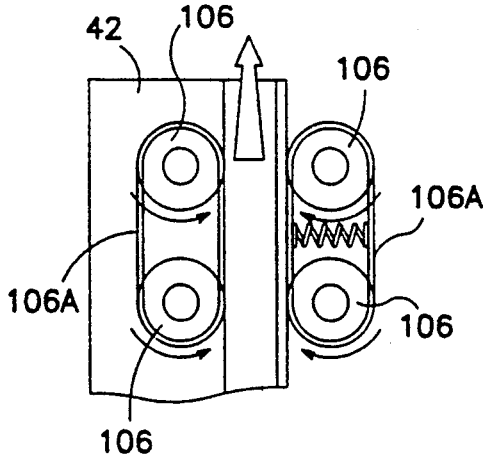
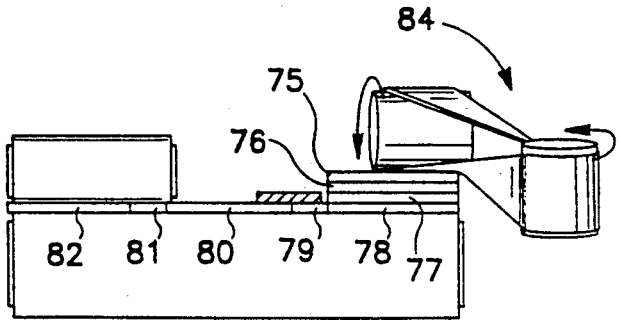
FIG. 25

FIG. 37
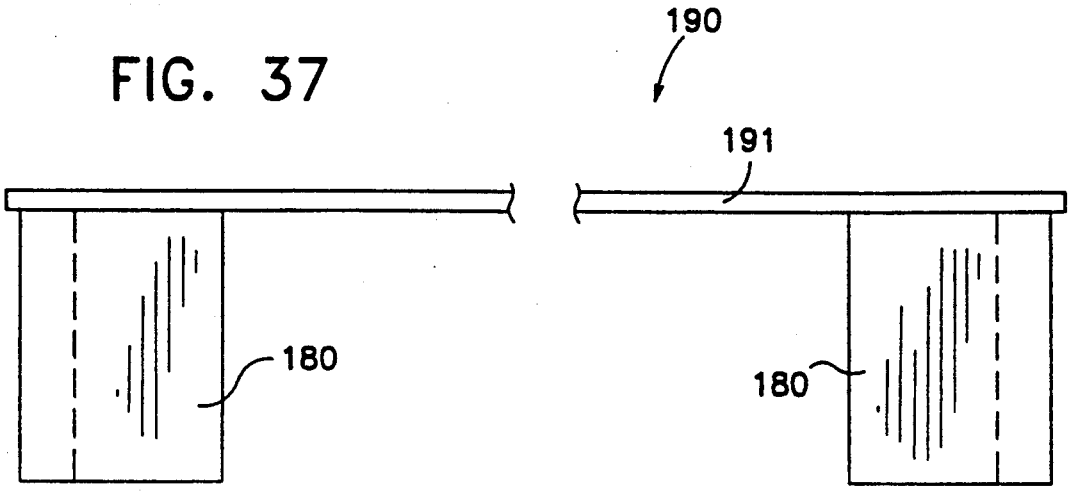
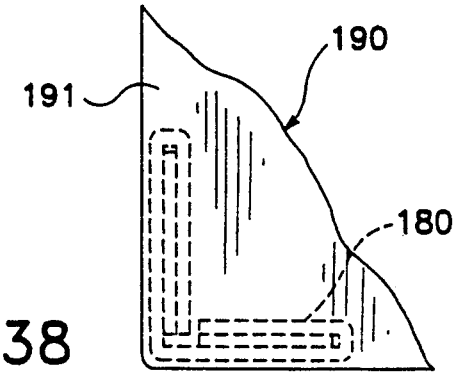
FIG. 38
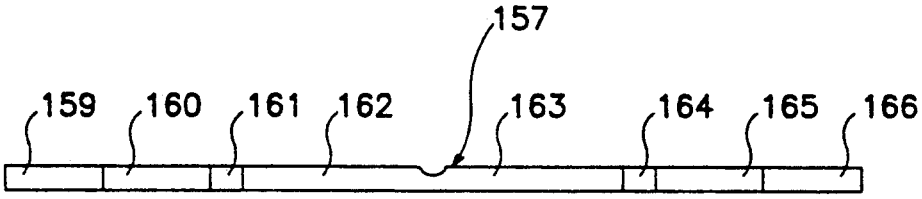
FIG. 34
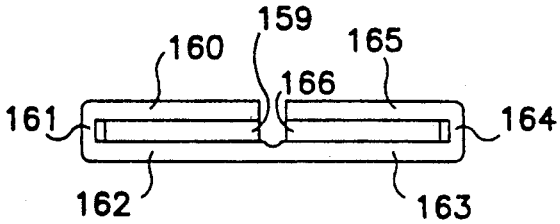
FIG. 35
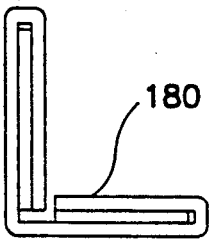
FIG. 36

METHOD AND APPARATUS FOR FOLDING OF SHEET MATERIAL

BACKGROUND OF THE INVENTION

1. Field of the Invention

The present invention broadly relates to a method and apparatus for manufacturing almost any object which includes at least one part formed of a folded sheet material. More particularly, the present invention relates to a continuous method and apparatus for manufacturing said part out of said sheet material. In one embodiment, the invention relates to a continuous method and apparatus for making stringers and cross stringers from corrugated sheet material and assembling them into pallets.

2. Description of the Prior Art

The present invention relates to improvements to the method and apparatus disclosed in my earlier U.S. Pat. No. 4,792,325 issued Dec. 20, 1988, and entitled "METHOD AND APPARATUS FOR MANUFACTURING CARDBOARD PALLETS", which is the most pertinent prior art of which I am aware.

Such method and apparatus proved entirely satisfactory as long as no design changes had to be made in the pallet produced thereby. However, as recyclable cardboard pallets became more and more popular, and were used for heavier and heavier loads, for certain applications the pallet made by said method and apparatus proved unsatisfactory. The stringers and cross stringers of said pallet, which had to be symmetrical because of the limitations of the method and apparatus, could not be folded tight enough to make stronger members. Also, the stringers were not glued to the cross stringers, and under certain conditions, vibrations had an adverse effect.

Also, the very nature of the recycling process resulted in pressure from the users of recyclable pallets to make changes in the method and apparatus practiced by said U.S. Pat. No. 4,792,325. Because the recycling process essentially involves a shredding as its first step, in any objects made with hot glue, the heat turns the glue soft, and the glue then clogs the shredder. Because of this there has been a growing demand that paper products, and especially pallets, be made with cold glue. The advance of pallet making technology has allowed for the spray application of cold glue.

A pallet is also more easily recyclable if the glue throughout the product is the same. Because the glue used in making the corregated cardboard is a cold glue, it is additionally desirable that the disposable pallet be assembled with cold glue. All the glue in the produce will then be a water based cold glue which will simply dissolve during the shredding and recycling process. Even if a non-water based cold glue is used to make waterproof cardboard constructions, the fact that the glue will not soften in the shredder aids in the recycling process. All of these factors made the design of a stronger, cold glued, disposable cardboard pallet mandatory.

When such a pallet was designed, several things were discovered. First, for increased strength it would be desirable if the cross stringers were of a different shape than the stringers. Secondly, it was found in the preferred embodiment of the pallet that that shape of the cross-stringer, was nonsymmetrical, and the blank used to manufacture it was nonsymmetrical. Thirdly, it was found that such a nonsymetrical blank could not be folded symmetrically from both sides at the same time, as required by said U.S. Pat. No. 4,792,325, making a redesign of the apparatus necessary. Lastly, it was found out that if compression could be maintained on the cardboard during the folding operation, a stronger member would be produced. The old apparatus simply was incapable of doing this, although several attempts were made.

For ease of understanding, the term "asymmetrical" will be used in the present application to designate any type of folding where the folding operation does not take place from the outside simultaneously (i.e., the blank of sheet material is being folded from only one side at a time), while the term "nonsymmetrical" will be used to refer to the cross section of a stringer or a cross stringer. It should also be understood that the term "asymmetrical" still applies to the folding operation, even if the pallet is repeatedly folded from one side, and whether it is ever folded from the other side.

When asymmetrical folding was tried using curvilinear rod means similar to those disclosed in said U.S. Pat. No. 4,792,325, problems immediately arose. It was found that since folding pressure was being applied from one side at a time, in contrast to being applied evenly from both sides as in said prior patent, hold-down means similar to those used in the prior apparatus were completely inadequate, and the blanks would tend to twist and jam the machine.

Furthermore, when stronger hold-down pressures were applied, it was found that the machine would jam because the combination of the increased hold-down pressures, and the friction applied by the continuous rod means, were so great that the machine simply did not have power enough to propel the blanks longitudinally therethrough. Increasing the power of the machine did not overcome the problems presented by trying to make asymmetrical folds. Also, the prior apparatus could not satisfactorily be modified to keep a member in compression while folding the same.

After much experimentation, it was found that the continuous rod means in the previous machine had to be completely discarded and replaced with a multifunctional folding means which not only folded the blank as it progressed longitudinally through the machine, but aided the drive belt used in propelling the blank through the machine, and compressed the member while folding, if desired. When this was done, it was found that a universal method and apparatus was provided which could symmetrically or asymmetrically fold a symmetrical or nonsymmetrical blank to produce symmetrical or nonsymmetrical parts. The parts can be assembled to form objects such as parts containers and the like. The parts can be produced under compression, if desired. Also, almost any type of corrugated sheet material can be used, regardless of the material from which it is made. It should also be understood that the method and apparatus is not limited to a "corrugated" sheet material, but can be used with any practicable sheet material.

SUMMARY OF THE INVENTION

The method and apparatus of the present invention solves the problems in the prior art by scoring and/or perforating, and/or crushing a blank of sheet material at a number of predetermined positions to provide a predetermined series of fold lines and corresponding panels in said sheet, along with performations and crushed areas if needed. The apparatus then folds the blank at the fold lines by moving the blank past a plurality of multifunctional folding means, including a lifting or elevating means to lift an outside edge of the blank while it is being longitudinally propelled through the apparatus so that it may be engaged by a folding and propelling means, such as a powered belt means, to propel and fold one panel of the blank over onto another panel of the blank as many times as is needed. The part thus produced may be secured by staples or other fastening means to secure the shape of the part or, in the most preferred embodiment, adhesive is applied to the blank substantially while the blank is being folded, to secure the blank into the shape of the part. The adhesive is then cured if necessary.

Thus, it is an object of the present invention to provide an improved method and apparatus for making an object including at least one part being formed of a folded sheet material.

It is a further object of the present invention to provide an improved method and apparatus for manufacturing parts formed of folded sheet material by a continuous process.

It is a further object of the present invention to provide an improved method and apparatus for manufacturing parts formed of folded sheet material, whereby the part, after the folding, gluing and curing operations take place, is in compression.

It is a further object of the present invention to provide an improved method and apparatus for making a fiberboard pallet including symmetrical and/or nonsymmetrical stringers and cross stringers.

A still further object of the present invention is to provide a method and apparatus of the foregoing nature which is capable of performing in a continuous manufacturing process.

A still further object of the present invention is to provide an economical method for manufacturing a cardboard pallet having an increased strength using commonly available materials.

Further objects and advantages of the present invention will be apparent from the following description and appended claims, reference being made to the accompanying drawings forming a part of the specification, wherein like reference characters designate corresponding parts in the several views.

BRIEF DESCRIPTION OF THE DRAWINGS

FIG. 7-B is an elevational view of a second portion of an apparatus construed in accordance with the present invention.

FIG. 23B is a view taken in the direction of the arrows, along the section line 23B—23B of FIG. 7-B.

FIG. 24 is a diagramatic elevational view, similar to FIG. 8, but showing the first of a series of steps needed to form the blank of FIG. 5 into a stringer.

FIG. 24A is a diagramatic elevational view showing the step subsequent to the step shown in FIG. 24.

FIG. 24B is a sectional view, taken in the direction of the arrows, along the line 24B—24B of FIG. 24-A.

FIG. 25 is a diagramatic elevational view showing the step subsequent to the step shown in FIG. 24-B.

FIG. 34 is an elevational view of a cardboard blank for forming a different part using the method and apparatus of the present invention.

FIG. 35 is a view of the blank shown in FIG. 33 after it has been partially folded into shape using the method and apparatus of the present invention.

FIG. 36 is an elevational view of the finished corner post made from the blank shown in FIG. 33.

FIG. 37 is an elevational view of a top assembly manufactured using the corner post shown in FIG. 35.

FIG. 38 is a partial plan view of the construction shown in FIG. 36.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

Figure 1:
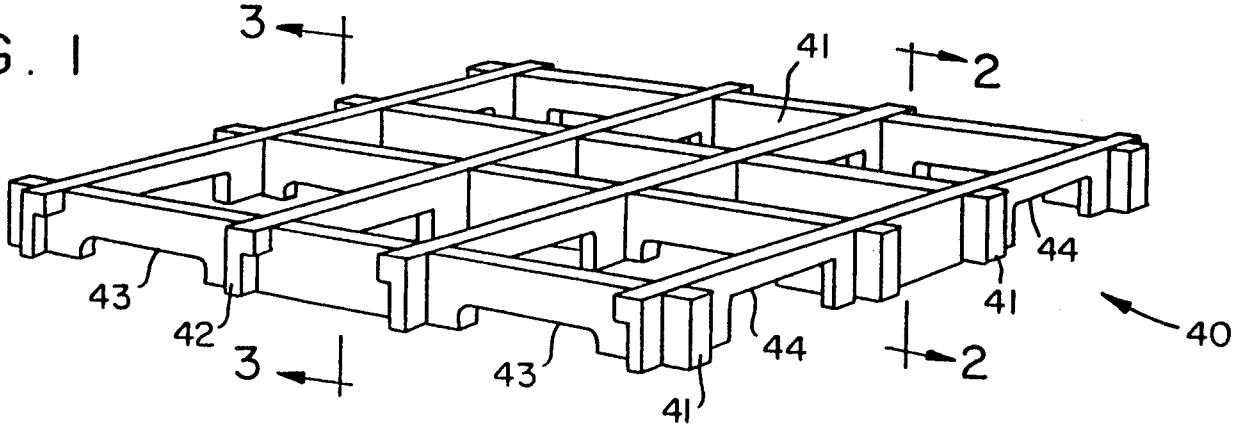
FIG. 1 is a perspective view of a cardboard pallet constructed according to the method and apparatus of the present invention, without the optional top or bottom sheets.
Figure 2:
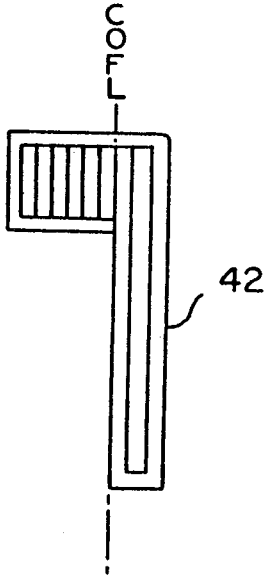
FIG. 2 is a sectional view, taken in the direction of the arrows, along the section line 2—2 of FIG. 1.
Figure 3:
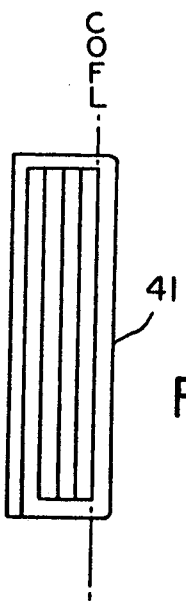
FIG. 3 is a sectional view, taken in the direction of the arrows, along the section line 3—3 of FIG. 1.

Referring to FIGS. 1-3 there is shown a pallet, generally indicated by the numeral 40, constructed according to the method of the and apparatus of the present invention, using a sheet of fiberboard or cardboard.

Such a pallet will typically consist of a number of stringers 41 and an equal number of cross stringers 42. Each stringer 41 will typically have a pair of notches or openings 43 therein to accept the forks of a forklift truck.

Likewise, each cross stringer 42 will have a pair of similar but larger, notches or openings 44, also designed to accept the forks of a forklift truck.

As shown in FIG. 3, in one embodiment of a pallet formed according to the present invention, the stringer 41 is of a symmetrical shape. As shown in FIG. 2, however, the cross stringer 42 is of a nonsymmetrical shape.

Figure 4:
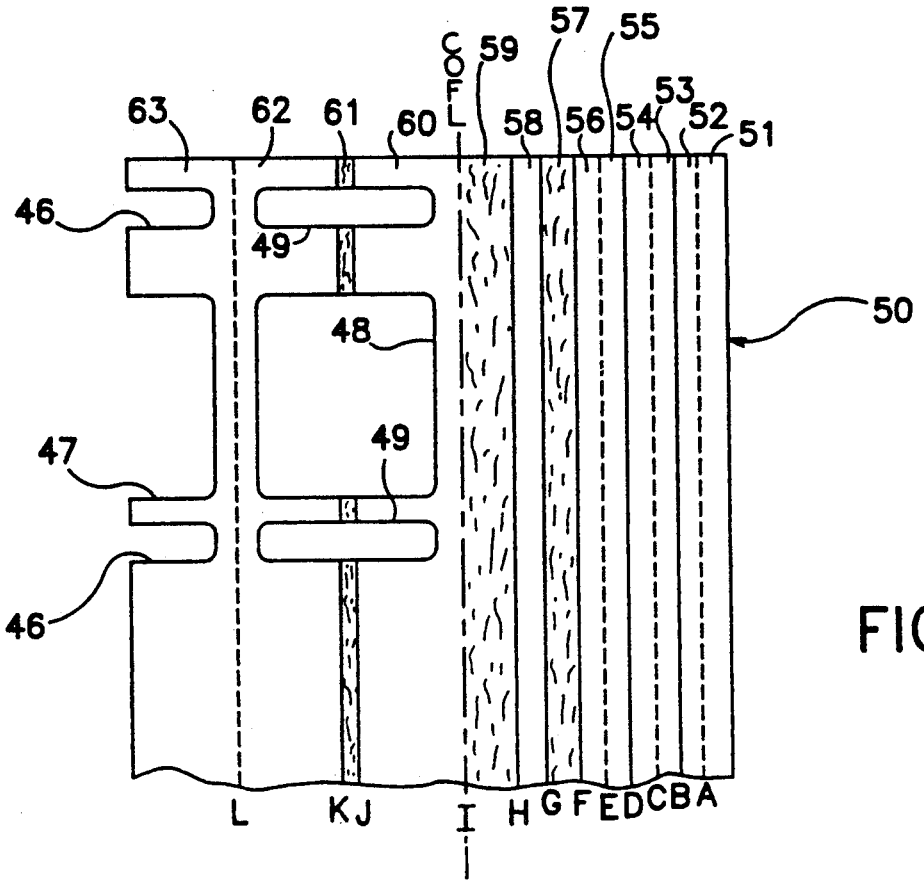
FIG. 4 is a partial plan view of a cardboard or fiberboard blank before being folded by the apparatus of the present invention into the cross stringer shown in FIGS. 1 and 2.

Referring now to FIG. 4, which shows a plan view of a first or cross stringer blank 50, the blank is shown immediately after it has passed through the crushing and scoring means 150 to be hearinafter described. First notches 46, second notch 47, square opening 48 and rectangular openings 49 have been previously placed in the blank 50, or may be placed in the blank 50 by adding a perforating function to the crushing and scoring means 150. Certain areas of the blank 50 have been crushed by the crushing portion of the crushing and scoring means 150 to form crushed panels 57, 59 and 61. The blank 50 has been scored on the bottom thereof along the lines indicated as A, C and E, while scores have been made in the top of the blank along the lines indicated at B and D. In this manner, fold lines A through L have been formed in the first blank 50, while also forming panels 51 through 63. The blank will be asymetrically folded, first from the left side to the center of fold line (COFL), and then from the right side to the center of fold line, to form the stringer shown in FIG. 2 by the method to be described immediately below. The COFL indicated in FIG. 4 is identical to the COFL indicated in FIGS. 2 and 6.

Referring now to FIGS. 7A-23A, the various steps in the manufacture of the cross stringer can be seen. The first, or cross stringer, blank 50, represented by the arrow in FIG. 7A, from which the cross stinger is to be made, is passed through the crushing and scoring means 150 to form a blank as shown in FIG. 4. The blank 50 is propelled by the belt 151 which, as shown in FIG. 8, supports a substantial amount of the blank. A plate 83 supports the rest of the blank 50. The belt 151 is a constant width from section 8—8 through section 11—11. Sufficient friction is kept on the blank 50 by the combination of the belt 151 and a series of pressure rollers 153 of a first width. As the blank progresses towards section 8—8 along the belt 151, it encounters a portion of a multi-function folding means 155 in the form of lifting or elevating means 157. lifting or elevating means 157 generally comprises a straight rod 158, together with a knife-edge folding plate 158A. It is important that the edge thereof be as close to the fold line as possible to insure ease of folding.

As the blank progresses from section 8—8 to section 9—9, the lifting means 157 hold the panel 62 against the plate 83, while lifting or elevating the panel 63 to an approximately 45° angle for engagement by the folding and propulsion means 84. As can be seen from FIG. 6, the folding and propulsion means 84 may form another portion of the multi-function folding means 155. In the illustrated embodiment of the invention, the folding and propelling means include a driven pulley 85 generally arranged on a horizontal axis, and an idler pulley 86, generally arranged in a vertical axis. The driven pulley 85 and the idler pulley 86 are connected by the belt 87. It can be seen as the first, or cross stringer, blank 50 proceeds from section 8—8 to section 9—9, the edge of the panel 63 is lifted by the straight rod 158 to an approximate 45° angle. At the end of the rod 158 the belt 87 is encountered, which now folds over the panel 63 onto the top of the panel 62.

Figure 13:
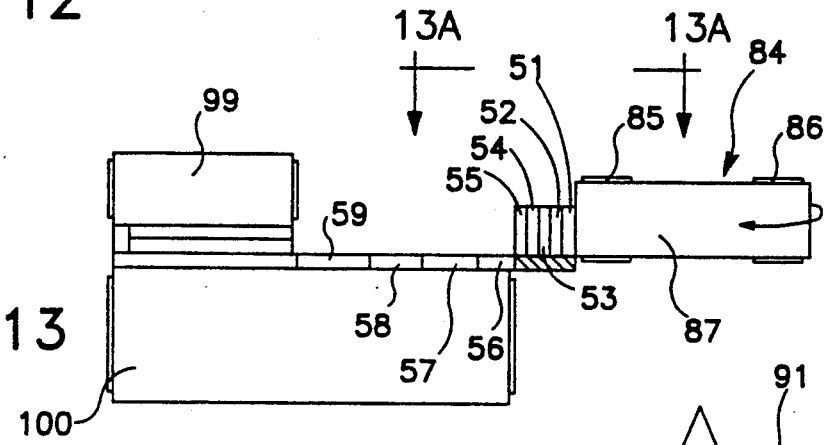
FIG. 13 is a sectional view, taken in the direction of the arrows, along the section line 13—13 of FIG. 7-A.
Figure 14A:
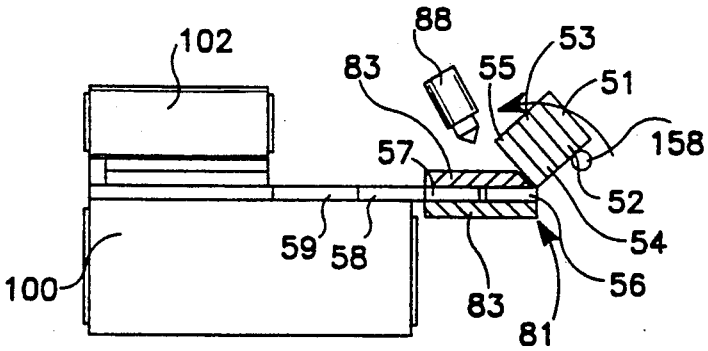
FIG. 14 is a sectional view, taken in the direction of the arrows, along the section line 14—14 of FIG. 7-A.
Figure 13A:
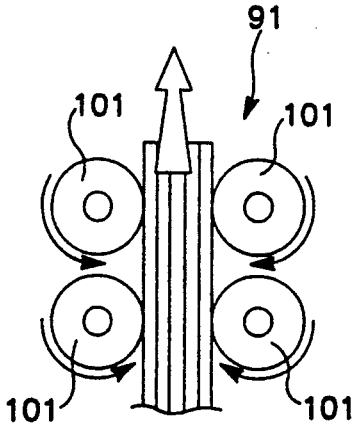
FIG. 13A is a view, taken in the direction of the arrows, along the section line 13A—13A of FIG. 7-A.
Figure 15:
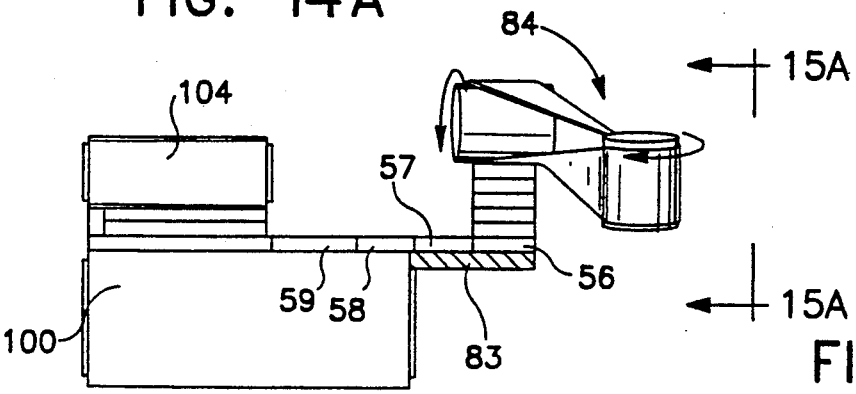
FIG. 15 is a sectional view, taken in the direction of the arrows, along the section line 15—15 of FIG. 7-A.
Figure 16:
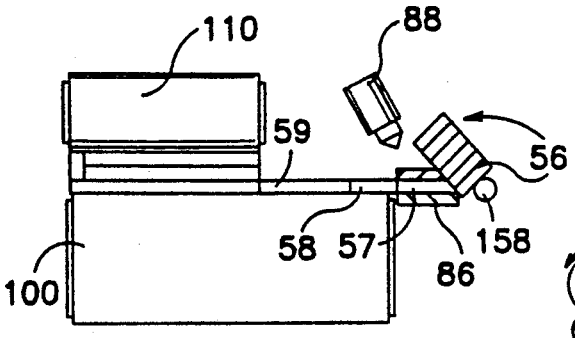
FIG. 16 is a sectional view, taken in the direction of the arrows, along the section line 16—16 of FIG. 7-B.
Figure 15A:
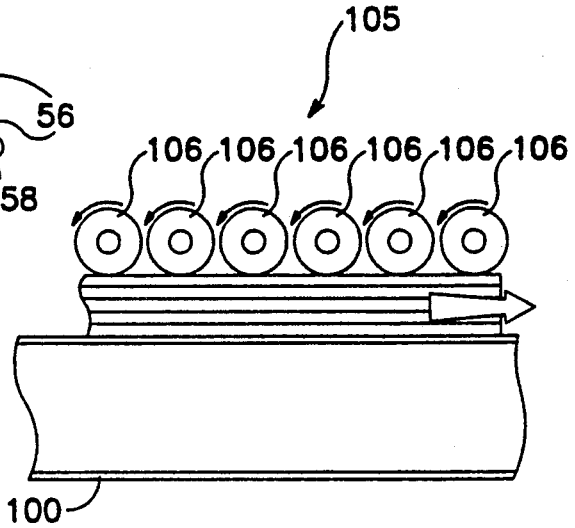
FIG. 15A is a sectional view, taken in the direction of the arrows, along the section line 15*a*—15*a* of FIG. 7-B.
Figure 17:
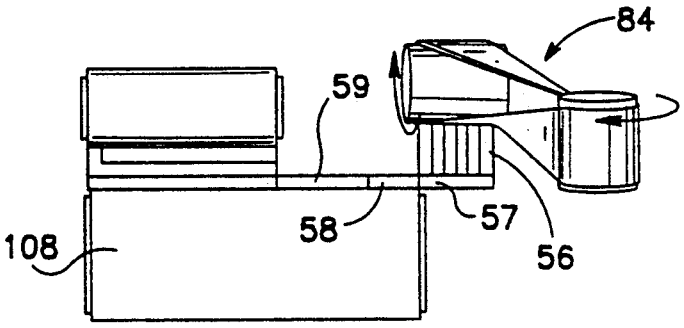
FIG. 17 is a sectional view, taken in the direction of the arrows, along the section line 17—17 of FIG. 7-B.
Figure 18:
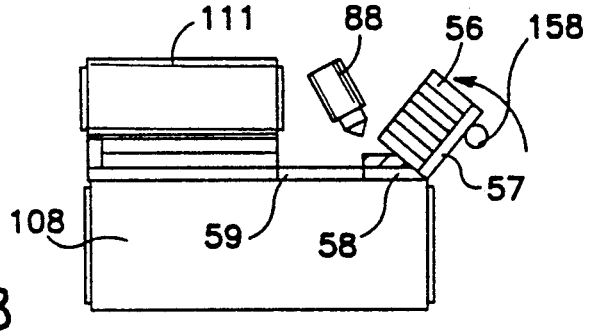
FIG. 18 is a sectional view, taken in the direction of the arrows, along the section line 18—18 of FIG. 7-B.
Figure 19:
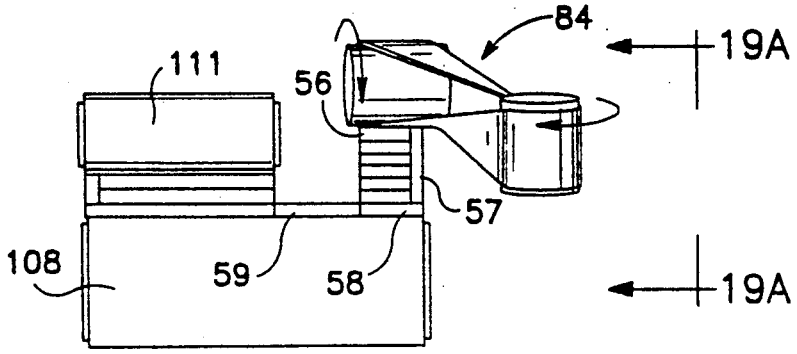
FIG. 19 is a sectional view, taken in the direction of the arrows, along the section line 19—19 of FIG. 7-B.
Figure 20:
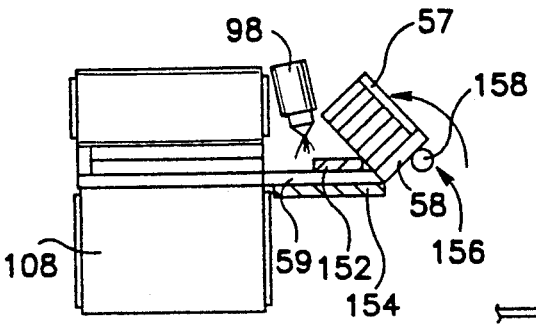
FIG. 20 is a sectional view, taken in the direction of the arrows, along the section line 20—20 of FIG. 7-B.
Figure 19A:
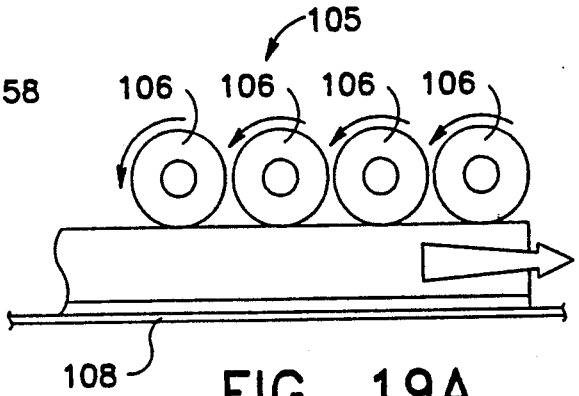
FIG. 19A is a sectional view, taken in the direction of the arrows, along the section line 19A—19A of FIG. 7-B.

It should be understood that the folding and propulsion means do not have to take the form shown in FIG. 6, but could also take the form shown in FIG. 13 for example, where the driven pulley 85 and the idler pulley 86 are arranged on parallel, spaced apart, vertical axis, and the belt 87 connects the two in a diagonal direction, as will be explained hereinafter. The orientation of the driven pulley 85, the idler pulley 86, and the belt 87 can very widely and still be well within the scope of the present invention. The only requirement is that they propel and fold substantially at the same time.

Figure 6:
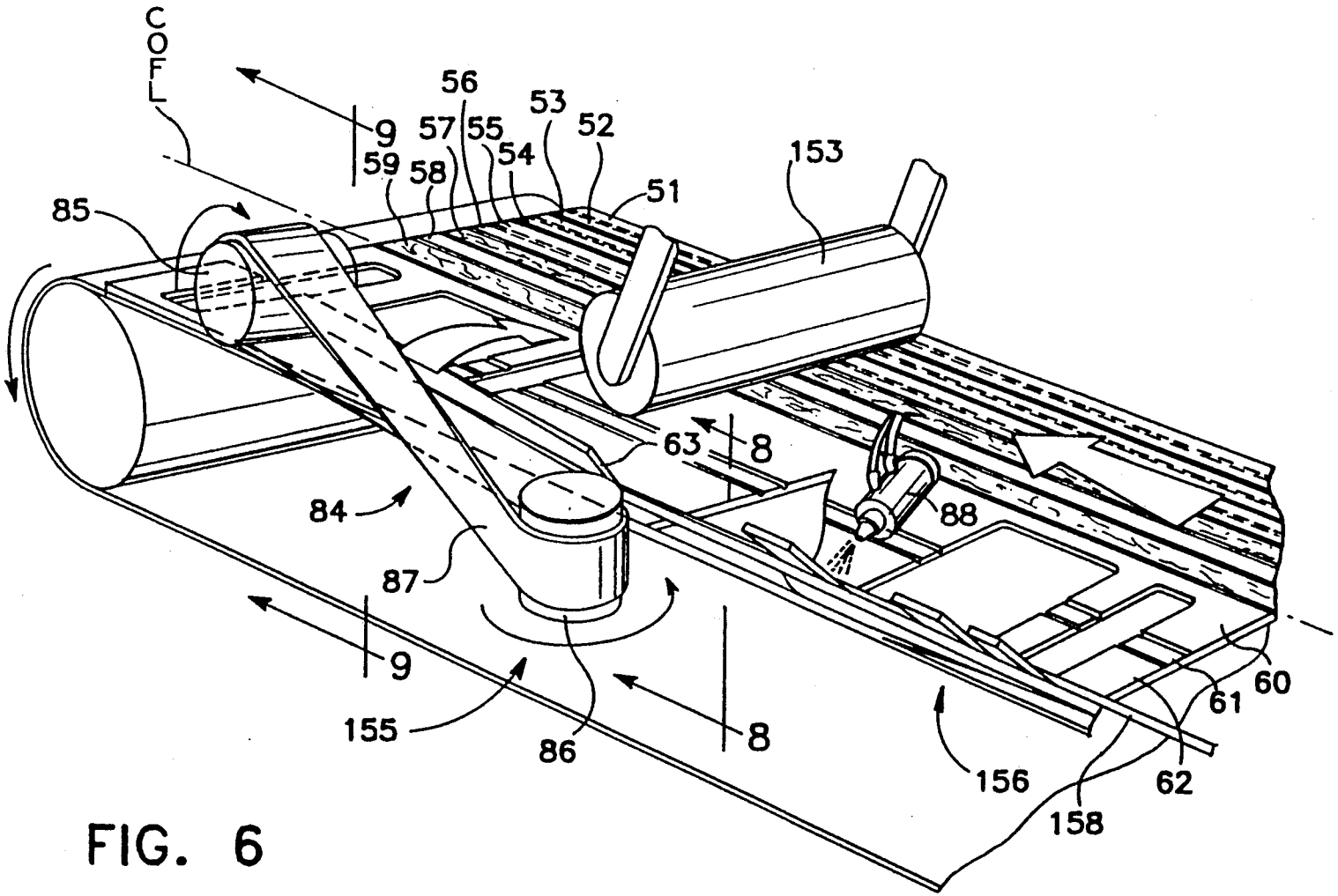
FIG. 6 is a diagrammatic view showing one form of the multi-functional folding means of the present invention.
Figure 8:
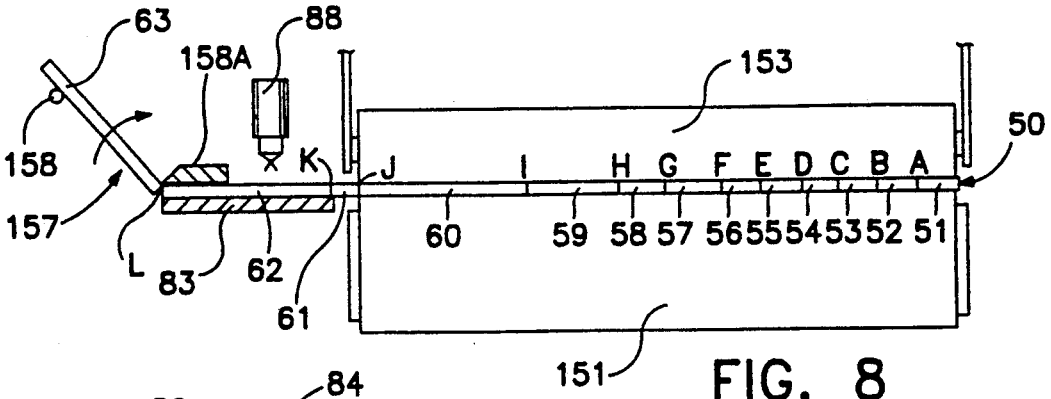
FIG. 8 is a sectional view, taken in the direction of the arrows, along the section line 8—8 of FIG. 7-A.
Figure 9:
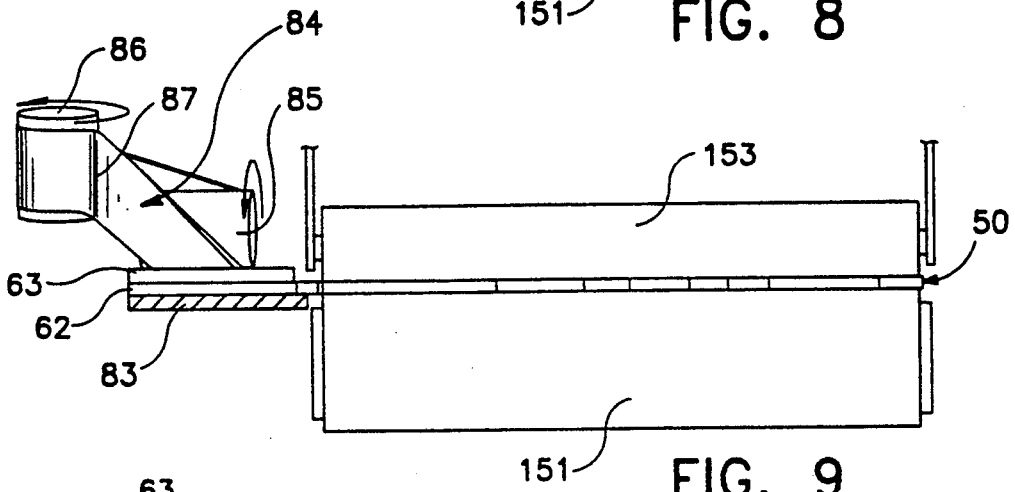
FIG. 9 is a sectional view, taken in the direction of the arrows, along the section line 9—9 of FIG. 7-A.
Figure 10:
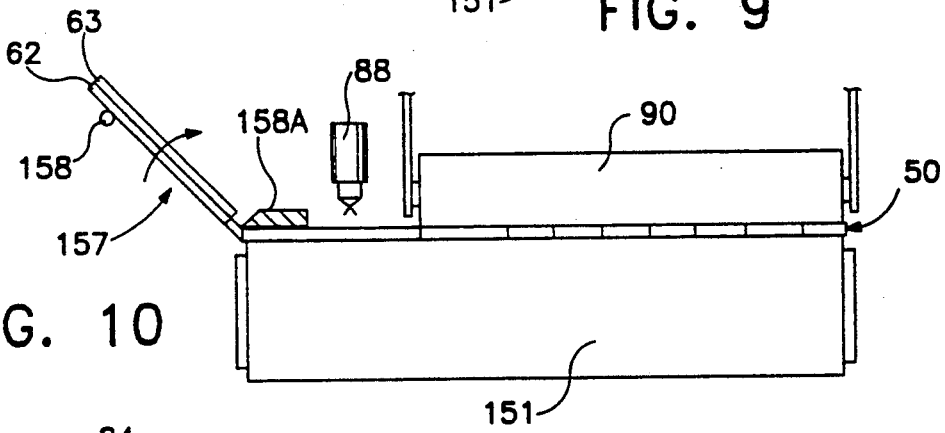
FIG. 10 is a sectional view, taken in the direction of the arrows, along the section line 10—10 of FIG. 7-A.
Figure 11:
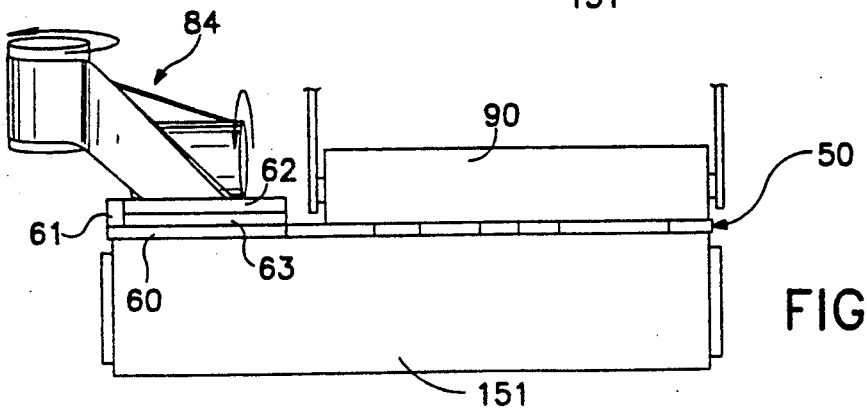
FIG. 11 is a sectional view, taken in the direction of the arrows, along the section line 11—11 of FIG. 7-A.
Figure 12:
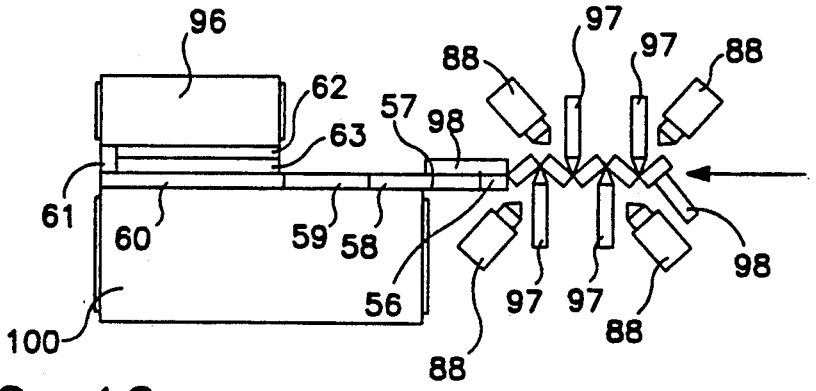
FIG. 12 is a sectional view, taken in the direction of the arrows, along the section line 12—12 of FIG. 7-A.

Still referring to FIGS. 6 and 8, before the panel 63 of the blank 50 reaches the folding and propulsion means 84 of FIG. 9, an adhesive is sprayed on the blank as indicated by the spray head 88.

As the blank 50 advances from section 9—9 to section 10—10, it again encounters a multi-function folding means 155 having a first portion in the form of lifting means 157 comprising the straight rods 158. At this time, the blank 50 is being propelled along belt 151 by a series of pressure rollers of second width 90. The construction formed of the panel 63 folded onto the panel 62 is lifted by the rod 158 to an approximate 45° angle as the blank 50 travels past section 10. As this occurs, a second spray head 88 is applying glue to panel 60. As the blank 50 travels from section 10—10 to section 11—11, it encounters the folding and propulsion means 84 and the assembly consisting of the panel 62 and 63 is folded over onto panel 60.

As the blank passes from section 11—11 to section 12—12, it passes through a curing means 91 during which pressure is applied to the assembly consisting of the panels 60, 61, 62 and 63. Generally, the curing means 91 will take the form of a frame 92 (FIG. 7A) to which a pair of pressure rollers of varying widths such as second width 90, are mounted, or will take the form of a frame 92 having a driven belt mounted thereto by means well known in the art such as belt 94 operating over pulleys 95. Also performing a curing function are belts such as belt 96 shown in FIG. 12 which continues pressure on the construction formed by the panels 60, 61, 62 and 63, while other operations are performed on the other side of the blank 50.

As the blank 50 approaches section 12—12, the said assembly passes out from under second belt 94 and under a third belt 96 which again is for the purpose of maintaining pressure on the folded portion of the assembly to aid in curing the glue. At section 12—12 the folding from the left side or edge of the first blank 50 is completed, and a folding from the right edge is started. A plurality of knife edge guides 97 and plates 98 serve to lift or elevate a portion of the blank 50, consisting of panels 51, 52, 53, 54 and 55 into substantially a "W" shape, while spray heads 88 apply a glue or adhesive to portions of said panels.

As the assembly formed thus far passes from section 12—12 to section 13—13, the folded portion of the assembly consisting of panels 60, 61, 62 and 63 passes out from under third belt 96 and comes under fourth belt 99, while the underside of the blank is now supported by second drive belt 100, which is of a narrower width than drive belt 151. At section 13—13, folding and propulsion means 84 are encountered. At this station, the folding and propulsion means 84 takes the form of a pair of pulleys 85 and 86 mounted in a vertical axis in a spaced parallel relationship, and connected by belt 87, which performs the function of pushing the panels 51, 52, 53, 54 and 55 together against the rod 158. As the assembly formed thus far moves from section 13—13 to 13A—13A, the portion of the assembly consisting of said panels 51-55 immediately comes between curing means 91, in the form of a plurality of vertically mounted rollers 101, which simply keep pressure applied until the glue has a chance to set.

The blank now moves from section 13A—13A to section 14—14. It moves out from under fourth belt 99, and under fifth belt 102 which forms a portion of a further curing means 91. Fifth belt 102 is driven and supported by pulleys 103 and simply acts to keep pressure on the assembly consisting of panels 60, 61, 62 and 63 while the glue is drying. After the assembly moves out from under curing means 91, it comes under sixth belt 104 which performs the same purpose. While the assembly is traveling under sixth belt 104, lifting means 157 consisting of rod 158 and plates 83 and 83A lift the portion of the assembly consisting of panels 51-55 at about a 45° angle. As the assembly formed thus far continues on to section 15—15, the portion of the assembly just folded comes into contact with folding and propulsion means 84 which folds this portion of the assembly over onto panel 56.

The assembly formed thus far then passes through another curing means 91 on its way to section 15A—15A. At section 15A—15A there is a curing and compression means 105 to keep pressure on the assembly while it is curing. The curing and compression means consist of a plurality of compression rollers 106 which keep pressure on the portion of the assembly consisting of panels 51-56 while the assembly is curing. As the assembly moves from section 15A—15A to section 16—16, the assembly formed thus far remains under seventh belt 110, and comes in contact with lifting means 156 comprising rod 158 and narrower plates 89. Glue or adhesive is sprayed as shown by spray head 88.

Now the assembly passes from section 16—16 to section 17—17. The assembly comprising panels 51-56 is folded over onto the top of panel 57 by folding and propulsion means 84. On its way to section 18—18, the assembly formed thus far passes under another curing means 91 which aids in the drying of the glue, and then the assembly comes under eighth belt 111, which may be identical to seventh belt 110. At this station the folding and propulsion means 84 folds the assembly consisting of the panels 51-57 over onto panel 58.

As the assembly moves out from under eighth belt 111 on its way to section 20—20, it passes through section 19A—19A where it encounters another curing and compression means 105 consisting of a plurality of rollers 106, again to keep pressure on the assembly while it dries, which will help ensure the construction remaining in compression when the assembly is dry.

The assembly now proceeds to section 20—20, where it encounters lifting means 157 consisting of rod 158 and plates 152 and 154, which lift the assembly consisting of panels 51-58 up over panel 59 while glue is being applied from spray head 88. As the assembly formed thus far moves from section 20—20, shown in FIG. 20, to section 21—21, shown in FIG. 21, it encounters another folding and propulsion means 84 to complete the fold.

Figure 21:
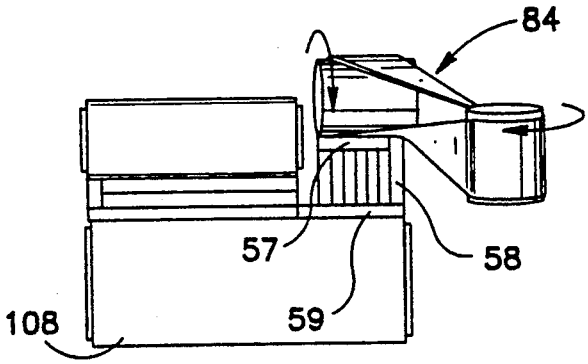
FIG. 21 is a sectional view, taken in the direction of the arrows, along the section line 21—21 of FIG. 7-B.
Figure 22:
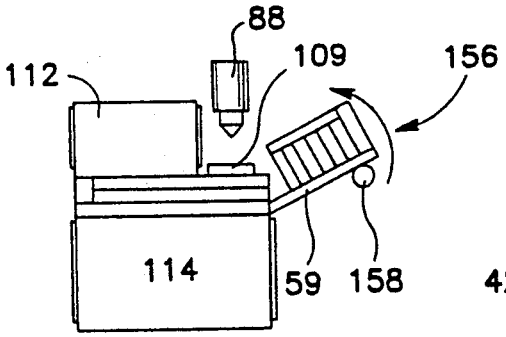
FIG. 22 is a sectional view, taken in the direction of the arrows, along the section line 22—22 of FIG. 7-B.
Figure 23:
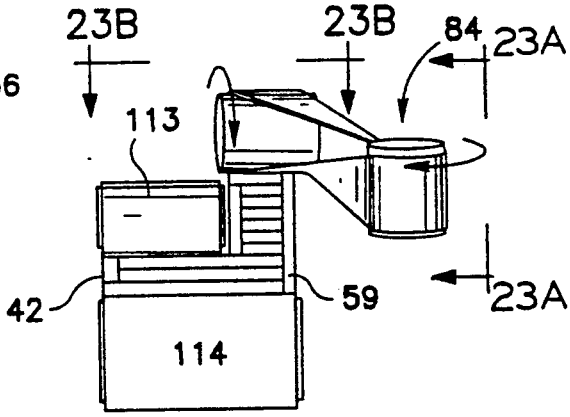
FIG. 23 is a sectional view, taken in the direction of the arrows, along the section line 23—23 of FIG. 7-B.
Figure 23A:
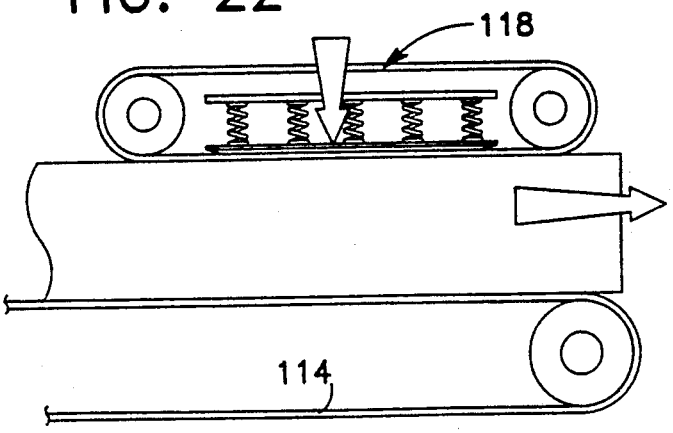
FIG. 23A is a sectional view, taken in the direction of the arrows, along the section line 23A—23A of FIG. 7-B.

As the assembly moves from section 21—21, as shown in FIG. 21, to section 22—22, as shown in FIG. 22, pressure is kept on the assembly consisting of panels 60-63 by ninth belt 112 pressing the assembly against rollers 113. While this is occurring the assembly consisting of the panels 51 through 59 is lifted by lifting means 157 comprising rod 158 and plate 109 while spray head 88 sprays glue on top of the assembly consisting of panels 60-63.

As the assembly moves from section 22—22 to section 23—23, it moves out from under ninth belt 112, under tenth belt 113, which is pressing the assembly against roller 114 while the propelling and folding means 84 folds the assembly consisting of panels 51-59 up and over the assembly consisting of panel 60-63 to form the L-shape of the cross stringer 42.

Immediately after passing the propelling and folding means 84, the assembly comes to section 23A—23A which is a curing means 91 including a spring loaded belt assembly 118 which presses the assembly against the rollers 113. Although not shown for the sake of clarity, all the belts shown in FIG. 7-A past Section 11—11 will be of the spring loaded type 118, except for belts 87 in the folding and propulsion means 84, and drive belts 100, 108 and 114. This will also be true when making the stringer 41, described immediately below. Depending on the particular application, the amount of tension desired may vary a great deal. A large amount of tension in pallet members is required to keep those members as "solid" as possible. Little or no tension, and thus, fewer or no spring loading of the belts may be required in other applications.

Immediately after this occurs, when the assembly formed thus far moves to section 23B—23B as shown in FIG. 23B, a further curing and compression means 105 is encountered which applies lateral pressure to the assembly. In this step, the compression rollers 106 are connected by belts 106A to aid in driving the construction formed thus far, and one side is spring loaded to take up any slack caused by tolerance stack up. After passing through the compression and curing means 105, the manufacture of the cross stringer 42 is complete.

Figure 5:
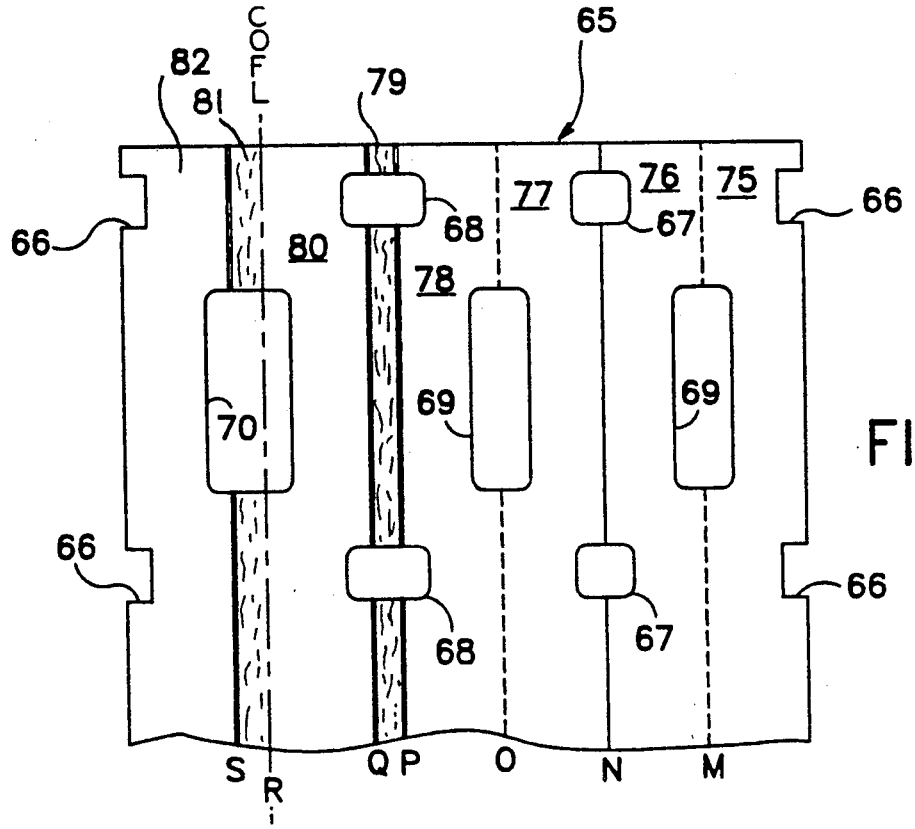
FIG. 5 is a partial plan view of a cardboard or fiberboard blank before being folded by the apparatus of the present invention into the stringer shown in FIGS. 1 and 3.

Referring now to FIG. 5, there is illustrated the second, or stringer blank, generally indicated by the numeral 65. As before, the stringer blank 65 has been prepared by previously placing small notches 66, small square openings 67, small rectangular openings 68, large rectangular openings 69 and larger rectangular opening 70 in the blank. The second blank 65 is then passed through the crushing and scoring means 150. Panels indicated by the numerals 79 and 81 have been crushed, and scores have been placed in the panel at positions M and O to form panels 75 through 82 respectively. The same type of equipment will be needed to process the second, or stringer, blank 65 as was needed to process the first or cross stringer blank 50. A crushing and scoring means 150 will be needed. A series of drive belts of different sizes, such as the drive belt 151 as shown in FIG. 6, will be needed. A plurality of pressure rolls of different widths, such as the pressure roller 78, also as illustrated in FIG. 6, will be needed to maintain pressure of the stringer blank 65 along the drive belt to ensure forward movement there along. As before, the blanks will be asymmetrically folded by a number of multifunction folding means 155, the glue will be cured after folding, as needed, by a plurality of curing means 91 or curing and compression means 105. With the diagramatic illustration of the steps involved in folding the stringer blank 65 as shown in FIGS. 24 through 29, the construction of the actual equipment will be obvious to one skilled in the art, and thus elevational views, such as 7-A and 7-B, of the actual apparatus needed to fold the stringer blank 65 are omitted.

Referring now to FIG. 24, the knife-edge guides 97 break the stringer blank 65 along the fold lines M, N, and O and lift the same into a "V" shape, while spray heads 88 spray adhesive on the top and bottom thereof. A folding and propulsion means 85 pushes panels 75, 76, and 77 together as shown in FIG. 24A, with these panels passing through a compression and curing means 105 (FIG. 24B) consisting of rollers 106. The rollers compress the panels together while the glue is curing.

As shown in FIG. 25, another folding and propulsion means 84, will fold the assembly consisting of the panels 75, 76 and 77 over onto the top of panel 78.

Figure 26:
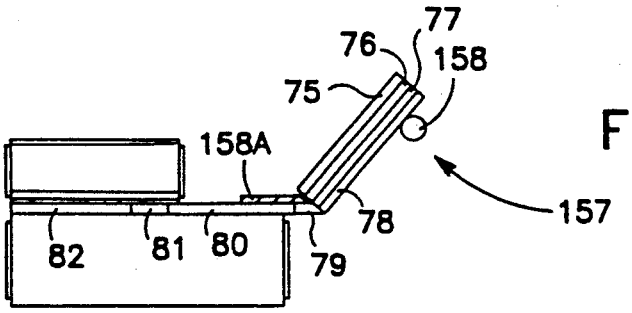
FIG. 26 is a diagramatic elevational view showing the next step in sequence.
Figure 27:
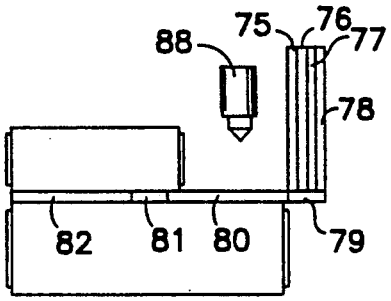
FIG. 27 is a diagramatic elevational view showing the next step in sequence after FIG. 26.
Figure 28:
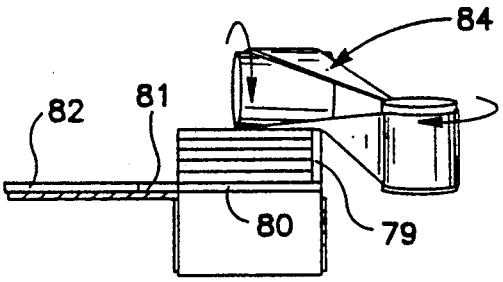
FIG. 28 is a diagramatic elevation view showing the step sequential to FIG. 27, and showing the last asymmetrical fold from the right hand side on the blank shown in FIG. 5.
Figure 29:
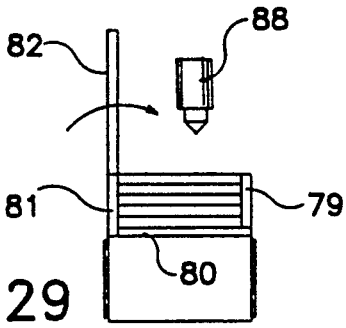
FIG. 29 is a diagramatic elevational view showing the step sequential to FIG. 28, and the first asymmetrical fold from the right in the making of the stringer shown in FIG. 3 from the blank shown in FIG. 5.

In FIG. 26, a lifting means 157 similar to that shown in FIG. 6, and comprising the rod 158 and knife-edge folding plate 158A, now lifts the edge of the assembly consisting of panels 75, 76, 77 and 78 up to an approximately a 90° angle. Glue is then sprayed on panel 80 as shown in FIG. 27. A folding and propulsion means 84 then folds the assembly over onto the top of panel 80, as shown in FIG. 28.

Figure 30:
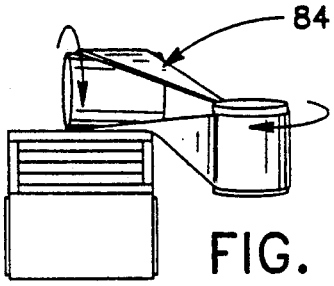
FIG. 30 is a diagramatic elevational view showing the step sequential to that shown in FIG. 29.
Figure 31:
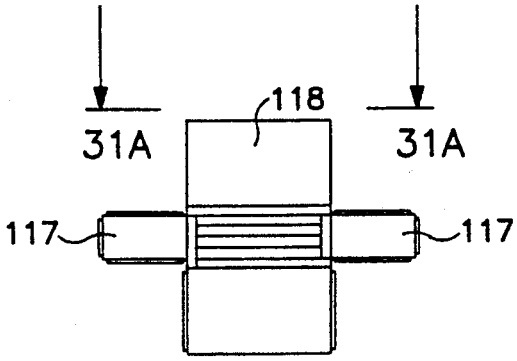
FIG. 31 is a diagramatic elevational view showing the steps sequential to FIG. 30.
Figure 31A:
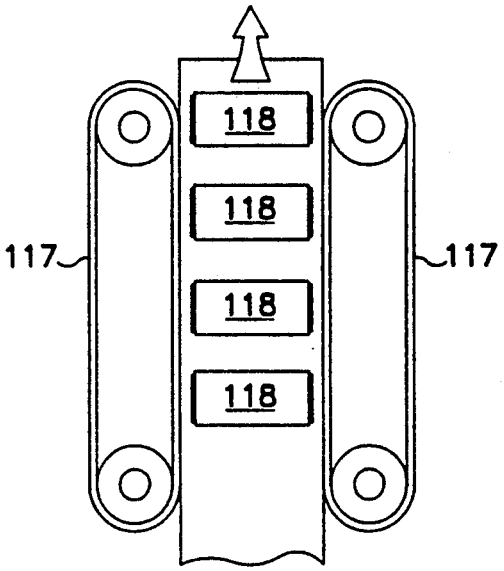
FIG. 31A is a view, taken in the direction of the arrows, along the line 31A—31A of FIG. 31.

While pressure is maintained on the assembly consisting of panels 75–80 lifting means (not shown) will lift panels 81 and 82 to approximately a 90° angle (FIG. 29) while folding and propulsion means 84 (FIG. 30) will fold panel 82 over panel 78. As shown in FIGS. 31 and 31A, side belts 117 and pressure rollers 118 maintain pressure on the stringer to keep it in compression while the same is drying.

Figure 33:
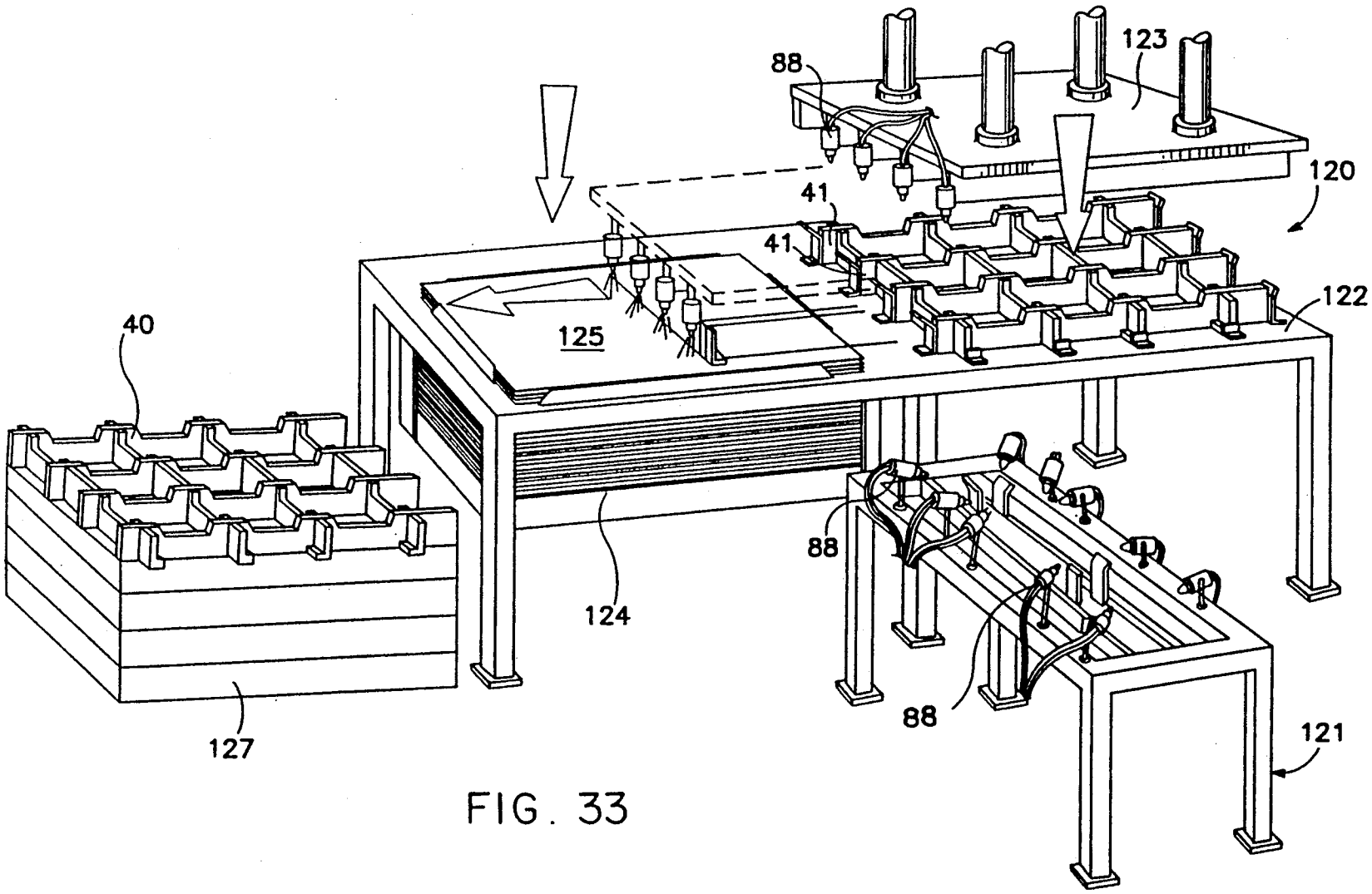
FIG. 33 is a diagnamatic perspective view of a palet assembly machine.

Referring now to FIG. 33, there is shown an assembly apparatus for assembling the stringers and cross stringers and applying a top sheet to the pallet 40. There is shown an assembly apparatus, generally designated by the numeral 120, which includes a glue application apparatus 121 for applying glue to cross stringers 42 before they are put in the jig means 122. Typically, cross stringers are placed in a fixture in the glue application apparatus or table 121, and a plurality of spray heads 88 apply glue to the notches in which the stringers will be inserted. These are placed in the jig means 122, and then the operator places an equal number of stringers 41 into the cross stringers 42. A pressure application means 123 then comes down and applies pressure to the assembly for a predetermined amount of time until the glue is cured.

The pressure application means 123 then moves laterally until it is over a top sheet feeding means 124, into which a plurality of top sheets 125 has been placed for presentation one at a time at the surface 126 of the assembly apparatus 120. To accomplish this, grippers (not shown) on the pressure application means 123 pick up the pallet 40 and begin a lateral movement to present it over a top sheet 125. As this is done, the spray heads 88 mounted on the edge of the pressure application means 123 apply glue where the stringers 41 will meet the top sheet 125. When the pressure application means 123 has the pallet 40 over a top sheet 125, it is lowered to apply pressure between the pallet 40 and the topsheet 125 until the glue is cured. While this operation is being done, the operator is using the glue application apparatus 121 to apply glue to a new series of cross stringers 42, and place them in the jig means 122.

When the glue is dry, the pressure application means 123 again picks up the now completed pallet and deposits it as the next pallet in the pallet stack 127.

Figure 32:
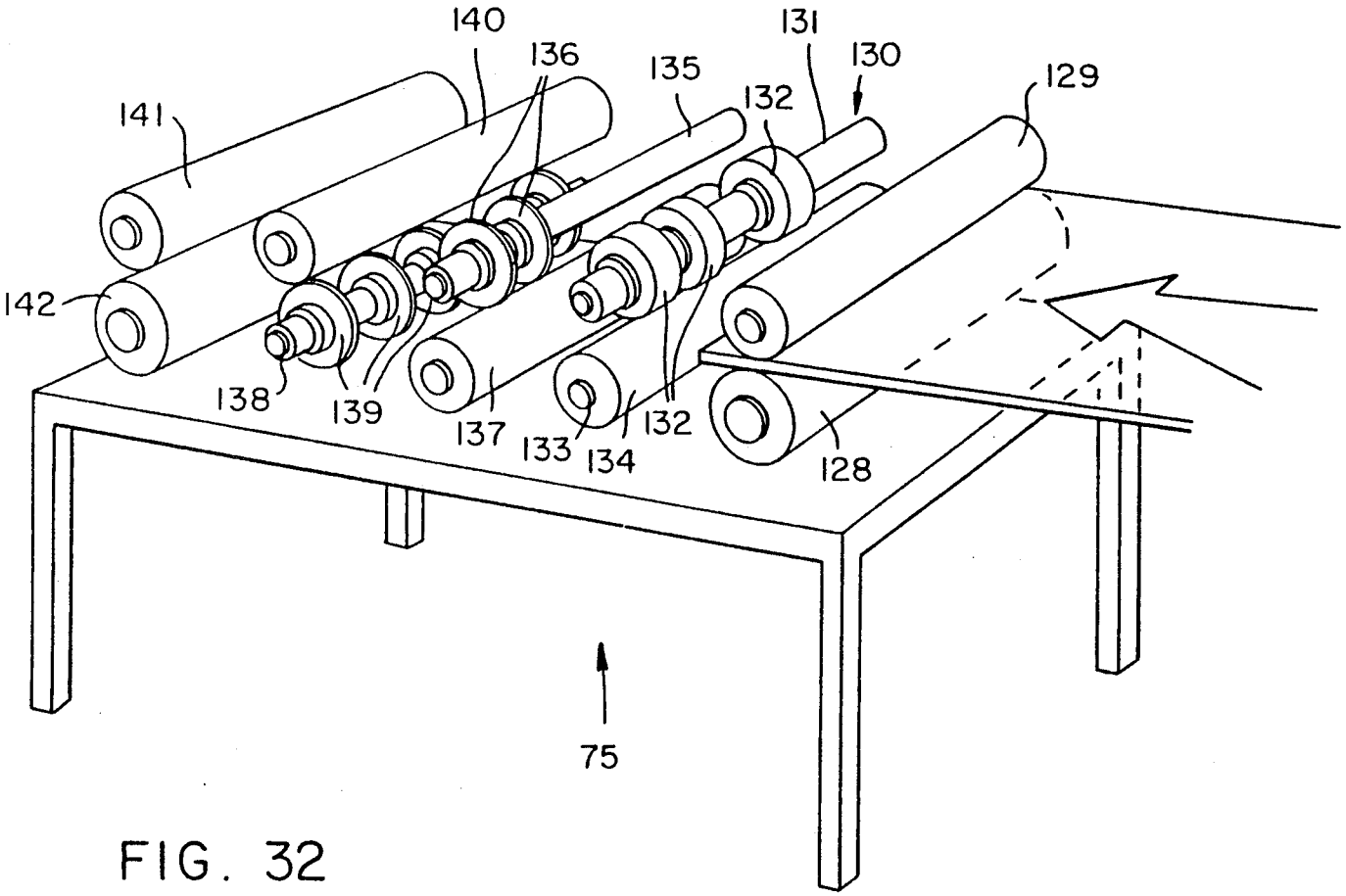
FIG. 32 is a diagramatic perspective view of a crushing and scoring means which may be used in the present invention to form a blank such as shown in FIGS. 4 and 5.

Referring now to FIG. 32, there is shown the crushing and scoring means 150 of the present invention. It is capable of crushing, perforating (if desired), and scoring from the top and the bottom simultaneously. The crushing and scoring means 150 will include a first pair of feeding rollers mounted to a suitable frame (not shown). Generally the lower feed roller 128 would be driven, while the upper feed roller 129 would be a pressure applying nondriven roller, but this arrangement may be varied as desired.

The cardboard or fiberboard blank, after being gripped by the feed rollers 128 and 129, would come to a crushing assembly generally designated by the numeral 130. The crushing assembly 130 will consist of a driven first shaft 131 mounted transverse to the direction of feed and having thereon mounted a plurality of crushing drums 132. The number and location of the drums will depend upon the number and location of the crushed areas to be placed in the blank. Referring to FIGS. 4 and 5, the blank 50 for the cross stringer will have three drums needed to produce the crushed areas 57, 59 and 61, while the blank 65 for the stringer would need two drums to produce the crushed areas 79 and 80. These crushing drums will be arranged in a close working relationship with the crushing feed roller 133, which is mounted parallel to the axis of the first shaft 131, and transverse to the direction of the feed. A rubber blanket 134 may be mounted to the feed roller 133.

The cardboard blank next encounters a scoring and means, including a second shaft 135, mounted transversely above the path of travel of the blank 50, on which are mounted a pair of scoring blades 136. The scoring blades are mounted in a closely spaced working relationship to a scoring drum 137, which is mounted in a parallel spaced relationship with the second shaft 135. The spacing between the scoring blades 136 and the scoring drum 137 is such that the scoring blades 136 will cut through all but the last layer of the cardboard blank 50. It should be understood, however, that depending on the application, the cardboard need not be cut at all, or even any of the scores.

If perforations were to be placed in the cardboard blank at the same time that the crushing and scoring were to take place, the scoring blades 136 may be replaced with a die cutting drum having the appropriate steel rule dies thereon in addition to the scoring means. In the preferred embodiment of the invention, however, for the particular blanks involved, it was found easier and more economical to manufacture the pallets if the blanks were die cut separately. This will vary from application to application.

Next in the path of travel of the blank 50 will come a second set of scoring blades consisting of the third shaft 138 mounted beneath the path of travel of the blanks so that the scoring wheels 139 mounted thereon will be scoring the blank from the bottom at the same time the scoring blades 136 are scoring the blank from the top. The second set of scoring blades may be said to be a mirror image of the first set of scoring blades, in that mounted above the path of travel, in a parallel spaced relationship, is a second scoring drum 140 which is spaced from the scoring wheels 139 only far enough to prevent the last or top sheet of cardboard of the corrugated blank from being perforated. Again, the cardboard may be cut to a lesser depth, or not at all, depending on the part being made.

After passing through the bottom mounted scoring wheels 139, a second pair of feed rollers is encountered by the blank 50 consisting of the upper second feed roller 141 and the lower second feed roller 142.

Figure 7A:
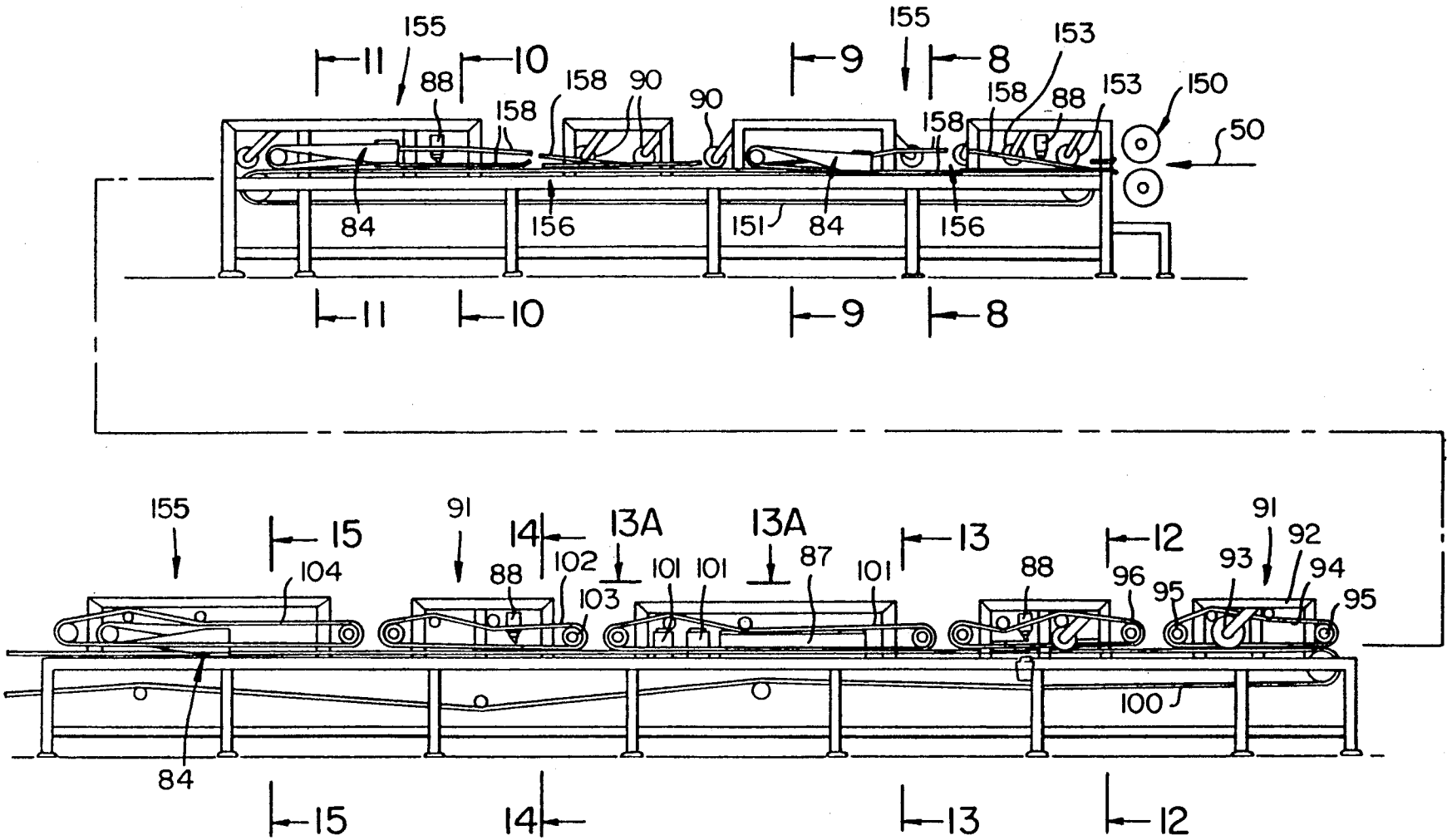
FIG. 7-A is an elevational view of a first portion of an apparatus construed in accordance with the present invention.
Figure 7B:
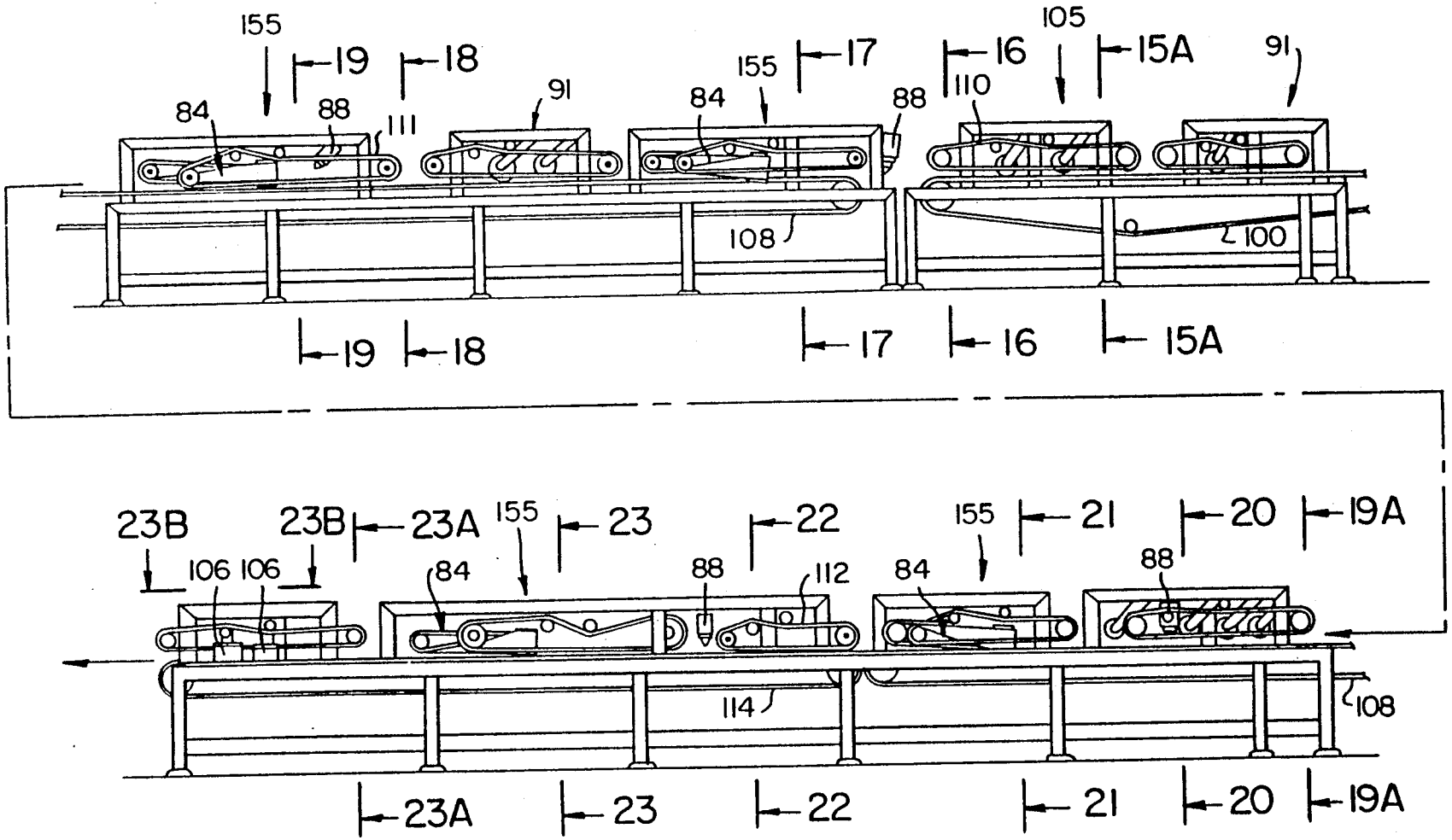

As shown in FIG. 7-A, it is desirable that the scoring, crushing and feeding means be mounted directly in front of and in alignment with the apparatus shown in FIG. 7A.

In the preferred embodiment of the present invention, the first shaft 131 carrying the crushing drums 132, and the second shaft 135, carrying the scoring blades 136, would be driven in unison, by means well known in the art, together with the third shaft 138 carrying the scoring wheels 139.

The driven feed roller 129, together with the lower scoring drum 137 and upper or second scoring drum 140 would be driven together with the lower second feed roller 142. As previously mentioned however, the driving arrangement of the various drums may vary depending upon the application to which the improved folding apparatus is put.

As previously stated, for environmental purposes it is preferred to use a cold glue throughout the folding process, regardless of the product being made. Cold glues such as Fullers and Bordens are preferred, but other cold glues may be used depending on the application.

Although cold glue is preferred, particular applications may require the use of hot glues for maximum economy and ease of manufacture. Hot glues such as Henkel, Bordens or Fuller are preferred for use in such a process. Regardless of whether hot glue or cold glue is used, the glue would be supplied to the various sprayheads 88 by means well known in the art consisting of a conduit, a reservoir, and a means of supplying or propelling the glue from the reservoir to the sprayheads. It should be noted that in some applications a sprayable glue may not be used, and in this instance gluing heads (not shown) would have to be provided along the path of the blank 50 in place of the sprayheads 88, which would considerably increase the cost of the apparatus, but may be necessary depending on the material being folded and the number and size of the folds being made. Also the use of heat lamps to help in curing the glue or adhesive that is used cannot be ruled out.

As previously stated, the method and apparatus developed to manufacture modern day disposable cardboard or fiberboard pallets proved to be so successful that in many cases it can also be used to make symmetrical folds in symmetrical blanks and still be preferred over the invention disclosed and claimed in said U.S. Pat. No. 4,792,325. An example of a folded part which has proved very desirable to manufacture on the present apparatus is the corner support generally indicated by the numeral 180 and shown in FIG. 36. The corner support 180 is made from the corner blank 157 shown in FIG. 34. The corner blank 157 would be folded on an apparatus of the type disclosed herein, except modified for the simpler operations being performed, and would be folded from the outside in to form the construction shown in FIG. 35. That is panels 159 and 166 would first be folded over and/or glued to the tops of panels 160 and 165. The construction formed thus far would be further folded until panels 159 and 160 were on top of panels 162, and panels 166 and 165 were on top of panels 163. The blank would then be folded to the shape shown in FIG. 35. As shown in FIGS. 36 and 37, the present method can be used as a part of manufacturing any object containing at least one part made of a folded sheet material. In this case, a protective cover 190 is formed of a top sheet 191 to which four of the corner supports 180 are attached by any suitable means. Virtually any part formed of a folded sheet construction can be manufactured by the method and apparatus of the present invention.

Thus, by carefully considering the problems present in the folding art, I have developed a novel method and apparatus for folding sheet materials which can make very complicated folded sheet constructions in a speedy and economical fashion.

We claim:

1. A method of making an object including at least one part formed of a folded sheet material, said method including the steps of:

(a) manufacturing said at least one part formed of a folded sheet material using a continuous process including the steps of:

i) scoring a blank of sheet material at a number of predetermined positions to provide a predetermined series of fold lines in said blank, ii) crushing the blank of sheet material at a number of predetermined positions to provide a predetermined series of crushed panels in said blank, iii) folding said blank at said fold lines by moving said blank past a plurality of multi-function folding means, and (b) assembling said at least one part formed of a folded sheet material to said object.

2. The method defined in claim 1, and including the further steps of:

a) applying adhesive to said blank at predetermined areas (if any) substantially while said blank is being folded, and b) curing said adhesive if needed.

3. The method defined in claim 2, and including the further step of perforating said blank before, during, or after scoring said blank.

4. The method defined in claim 2, and including the further step of crushing a portion of said blank before, during, or after scoring said blank.

5. The method defined in claim 4, where the step of folding said blank at said fold lines includes the step of asymmetrically folding said blank at said fold lines by moving said blank past a plurality of multi-function folding means, said multi-function folding means including a lifting means and a folding and propulsion means.

6. A method of making a cardboard pallet including the steps of:

(a) manufacturing a plurality of cross-stringers having notches therein to receive a stringer using a continuous process including the steps of:

i) scoring a first blank at a number of predetermined positions to provide a predetermined series of fold lines therein, ii) crushing the first blank of sheet material at a number of predetermined positions to provide a predetermined series of crushed panels in said first blank, iii) folding said first blank at said fold lines by moving said first blank past a plurality of multi-function folding means, iii) applying adhesive to said first blank at predetermined areas substantially while said first blank is being folded, and iv) curing said adhesive, if necessary:

(b) manufacturing a plurality of stringers for insertion into said cross-stringers using a continuous process including the steps of:

i) scoring a second blank at a number of predetermined positions to provide a predetermined series of fold lines therein, ii) crushing the second blank of sheet material at a number of predetermined positions to provide a predetermined series of crushed panels in said second blank, iii) perforating the second blank at a number of predetermined positions to provide a predetermined series of cutouts, iv) folding said second blank at said fold lines by moving said second blank past a plurality of multi-function folding means, v) applying adhesive to said second blank at predetermined areas while said second blank is being folded, and vi) curing said adhesive, if necessary:

(c) inserting said cross-stringers into said stringers to form said cardboard pallet.

7. The method defined in claim 6, and including the additional step of:

a) applying a top sheet to said pallet.

8. The method defined in claim 6, wherein the steps of folding said first and second blank at said fold lines includes the step of asymmetrically folding said first and second blank at said fold lines by moving said first and second blank past a plurality of multi-function folding means, said multi-function folding means including a lifting means and a folding and propulsion means.

9. A method of making a fiberboard pallet, said method including the steps of:

a) forming a plurality of cross-stringers by:

i) providing a first set of fiberboard blanks suitable for scoring, crushing and perforation, ii) passing said first set of fiberboard blanks through a crushing, perforating and scoring means to produce longitudinal score lines and longitudinally crushed panels in the first set of fiberboard blanks and to produce cutouts therein which, when said first set of blanks are folded, form notches to accept a stringer, iii) moving said first set of fiberboard blanks through a plurality of multi-function folding means to fold said first set of fiberboard blanks along said score lines, and iv) applying adhesive to predetermined portions of said first set of blanks and curing said adhesive as necessary, all substantially while folding said first set of blanks, to thereby produce a plurality of cross-stringers, and b) forming a plurality of stringers by:

i) providing a second set of fiberboard blanks suitable for crushing, scoring and perforation, ii) passing said second set of fiberboard blanks through a, perforating crushing and scoring means to produce longitudinal score lines and longitudinally crushed panels in the second set of fiberboard blanks and to produce cutouts therein which, when said second set of blanks are folded, form notches to accept a cross-stringer, iii) moving said second set of fiberboard blanks through a plurality of multi-function folding means to fold said second set of fiberboard blanks along said score lines, and iv) applying adhesive to predetermined portions of said second set of blanks and curing said adhesive as necessary, all substantially while folding said second set of blanks, to thereby produce a plurality of stringers, and c) inserting said cross-stringers into said stringers in an orthagonal relationship thereby forming a pallet.

10. The method defined in claim 9, and including the additional step of:

a) gluing a top sheet onto said stringers and cross-stringers.

11. The method defined in claim 10, and including the additional step of:

a) gluing a bottom sheet onto said stringers and cross-stringers.

12. The method defined in claim 11, wherein the step of applying and curing said adhesive includes the step of applying compression to said stringers and cross-stringers, during at least some portions of the curing step so that said stringers and cross-stringers are under compression after they are cured.

13. (new) A method of making an object including at least one part formed of a folded sheet material, said method including the steps of:

(a) manufacturing said at least one of said parts formed of a folded sheet material using a continuous process including the steps of:

(i) perforating a blank of sheet material to form a predetermined number of cutouts therein, crushing said blank material to form a predetermined number of longitudinal crushed panels in the sheet material, and scoring said blank of sheet material at a number of predetermined positions to provide a predetermined series of fold lines in said blank, (ii) folding said blank at said fold lines by moving said blank past a plurality of multi-function fold means, (b) assembling at least one of said parts formed of a folded sheet material to said object.

* * * * *